US007014282B2

(12) United States Patent
Hämmerle

(10) Patent No.: US 7,014,282 B2
(45) Date of Patent: Mar. 21, 2006

(54) PULL-OUT GUIDE FOR DRAWERS

(75) Inventor: Kurt Hämmerle, Lustenau (AT)

(73) Assignee: Julius Blum Gesellschaft m.b.H., Hochst (AT)

( * ) Notice: Subject to any disclaimer, the term of this patent is extended or adjusted under 35 U.S.C. 154(b) by 341 days.

(21) Appl. No.: 09/796,754

(22) Filed: Mar. 2, 2001

(65) Prior Publication Data

US 2001/0019235 A1 Sep. 6, 2001

(30) Foreign Application Priority Data

Mar. 2, 2000 (AT) ..... A 338/2000
Jul. 17, 2000 (AT) ..... A 1236/2000

(51) Int. Cl.
*A47B 88/04* (2006.01)

(52) U.S. Cl. ..... 312/334.4; 312/330.1

(58) Field of Classification Search ..... 312/330.1, 312/334.1, 334.4, 333, 334.5, 334.27, 351, 312/334.32
See application file for complete search history.

(56) References Cited

U.S. PATENT DOCUMENTS 4,441,773 A * 4/1984 Leiper ..... 312/330.1
4,815,796 A 3/1989 Röck ..... 312/263
4,842,422 A 6/1989 Nelson ..... 384/19
4,961,614 A 10/1990 Röck ..... 312/348.4
5,015,047 A * 5/1991 Nock ..... 312/334.11
5,056,879 A * 10/1991 Rock et al. ..... 312/334.27
5,281,021 A * 1/1994 Rock et al. ..... 312/330.1 X
5,348,386 A * 9/1994 Grass ..... 312/348.2 X
5,588,729 A * 12/1996 Berger ..... 312/330.1 X
5,664,855 A * 9/1997 Lautenschlager et al. ..... 312/334.4
5,779,333 A * 7/1998 Lautenschlager ..... 312/334.15
6,036,291 A * 3/2000 Rock ..... 312/333

FOREIGN PATENT DOCUMENTS

AT 400 659 2/1996
DE 2639686 * 3/1978 ..... 312/334.4
DE 39 19 919 6/1989
DE 39 39 257 6/1990
DE 41 14 708 11/1992
DE 44 14 462 11/1995

* cited by examiner

*Primary Examiner*—James O. Hansen
(74) *Attorney, Agent, or Firm*—Wenderoth, Lind & Ponack, L.L.P.

(57) ABSTRACT

A pull-out guide for drawers (2, 3, 4) includes, on the two sides of the drawer (2, 3, 4), a support rail on the carcass side and a pull-out rail (6) on the drawer side. The pull-out rails (6) have hooks (8) at their rear ends, and the hooks have horizontal holding lugs (10) which in the mounted position project into openings (9) in the drawer (2, 3, 4). The position of the holding lugs (10) or the hooks (8) with the holding lugs (10) on the pull-out rails (6) is adjustable in the vertical direction.

10 Claims, 5 Drawing Sheets

A – A

PULL-OUT GUIDE FOR DRAWERS

BACKGROUND OF THE INVENTION

The invention relates to a pull-out guide for drawers having rails on the sides of the drawer. In particular, each rail includes a support rail on the carcass side and a pull-out rail on the drawer side. The pull-out rails are provided at the rear ends with hooks which have horizontal holding lugs which, in the mounted position, project into openings in the drawer, preferably in the drawer frames. The invention further relates to a drawer having a pull-out guide of this type.

The conventional adjustment devices for wooden drawers (adjustment of inclination and height) are usually arranged in the vicinity of the front panel of the drawer for the sake of good accessibility. The disadvantage of this arrangement is that neither the height of the front panel nor the inclination of the front panel can be adjusted independently of one another. Instead, adjustment always takes place in both dimensions at the same time, although in most cases this is not desired. Furthermore, pull-out guide fittings are known in which the pull-out rails on the drawer side have at their rear ends hooks which project into bores in the drawer. The pull-out rails are thus anchored in the drawer at the rear end.

The object of the present invention is to provide an improved adjustment device by means of which it is possible to adjust only the inclination of the panel, with the height position of the panel being practically retained.

SUMMARY OF THE INVENTION

The object of the invention is achieved in that the position of the holding lugs or the hooks with the holding lugs on the pull-out rails is adjustable in the vertical direction.

The drawer of the invention has holding lugs or hooks with the holding lugs that may be moved in the vertical direction on the pull-out rails, with the drawer bearing on the pull-out rails in the front region, height-adjustably, by means of wedges. As used herein, the term "front end" or "front region" means an end or a region closest to a front panel of the drawer, while the term "rear end" or "rear region" means an end or a region opposite the front end or front region, and which is farthest from the front panel. If the height of the front panel is adjusted by displacing the wedges, the inclination of the panel which is thereby caused can be corrected by adjusting the hooks or holding lugs. In this way, the correct profile for a joint or for a panel in an item of furniture may be achieved. A preferred embodiment of the invention provides for the hooks or the holding lugs to be adjustable by means of a handle, without a tool.

BRIEF DESCRIPTION OF THE DRAWINGS

Two embodiments of the invention will be described below with reference to the figures of the accompanying drawing.

DETAILED DESCRIPTION OF THE DRAWINGS

Figure 1:
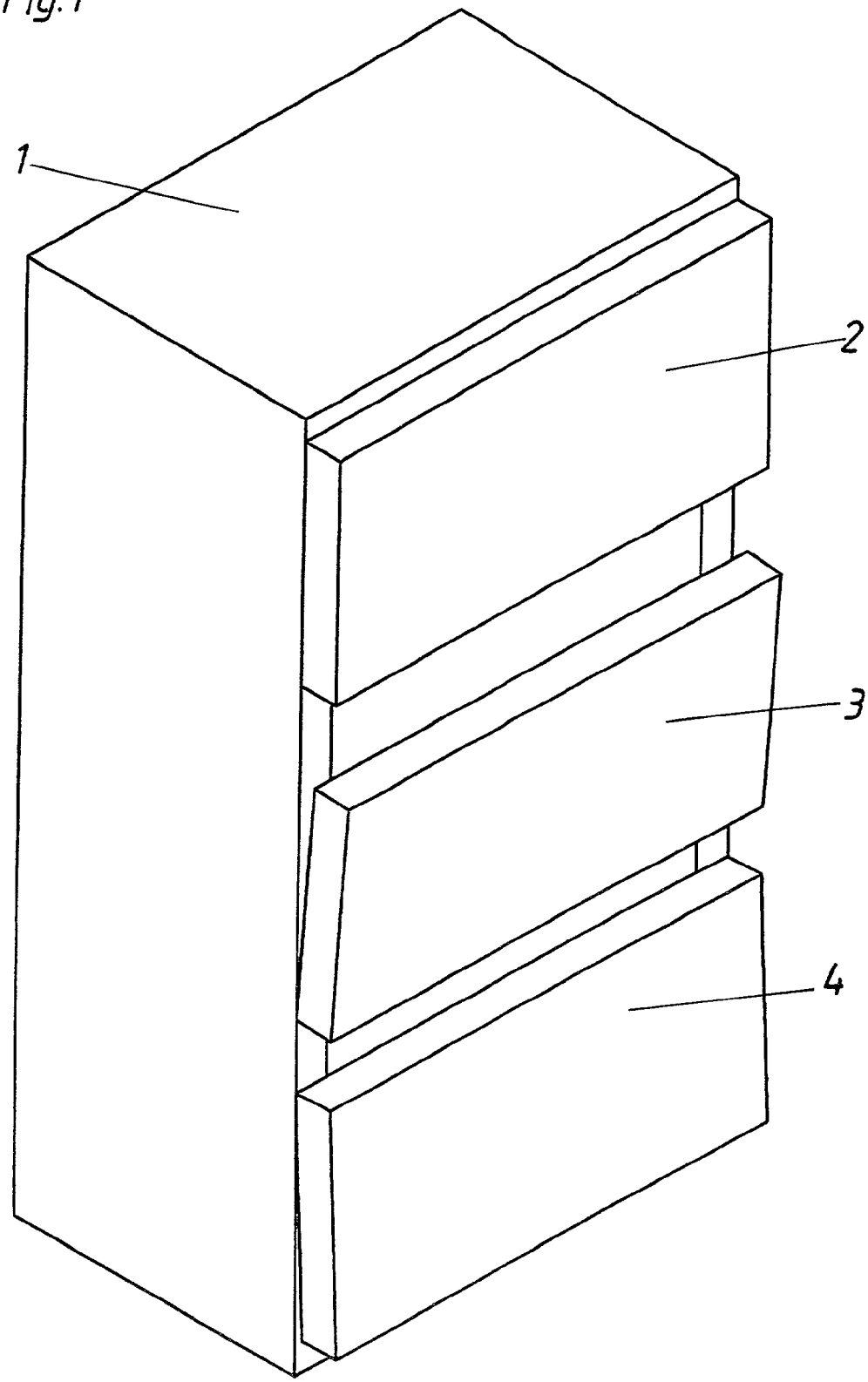
FIG. 1 shows diagrammatically an illustration of an item of furniture with drawers.

Drawers 2, 3, 4 are arranged one above the other in a furniture carcass 1, as shown in FIG. 1. The drawer 2 in this case is arranged in the centered position, with its front panel 5 aligned vertically straight. In the case of the drawer 3, the front panel 5 is inclined forwards, and in the case of the drawer 4 it is inclined towards the rear. The drawers 2, 3, 4 are anchored on pull-out rails 6 which each form part of a pull-out guide fitting.

Figure 3:
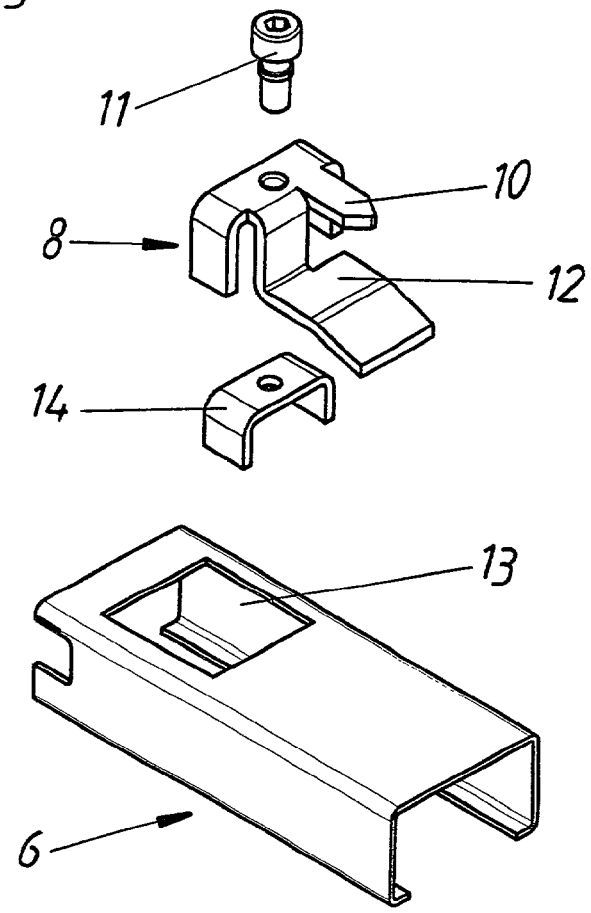
FIG. 3 shows diagrammatically and in exploded view the rear adjustment device.
Figure 5:
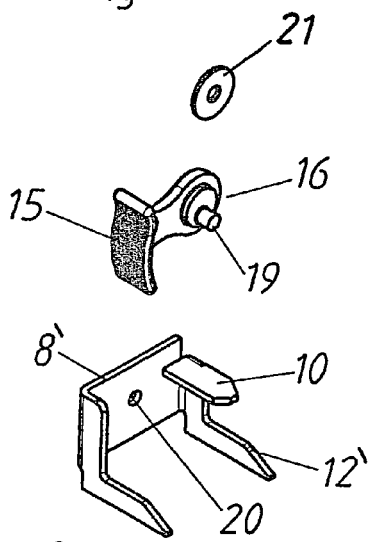
FIG. 5 shows an exploded illustration of the rear end of a pull-out rail and a further embodiment of the adjustment device.

The drawers 2, 3, 4 have a drawer frame (including the front panel 5, a rear panel, two side panels, and a bottom panel) which bears on the pull-out rails 6 in the front region by means of displaceable wedges 7. In the rear region of the drawers 2, 3, 4, an opening 9 is provided in each drawer frame for receiving a holding lug 10 of a hook 8. In other words, the holding lug 10 engages the drawer frame via the opening 9. As illustrated in FIGS. 3 and 5, the holding lug 10 has a basal end connected to a main body portion of hook 8, and has a distal end that protrudes in a horizontal direction so as to be received in the opening 9 of the drawer.

Figure 2:
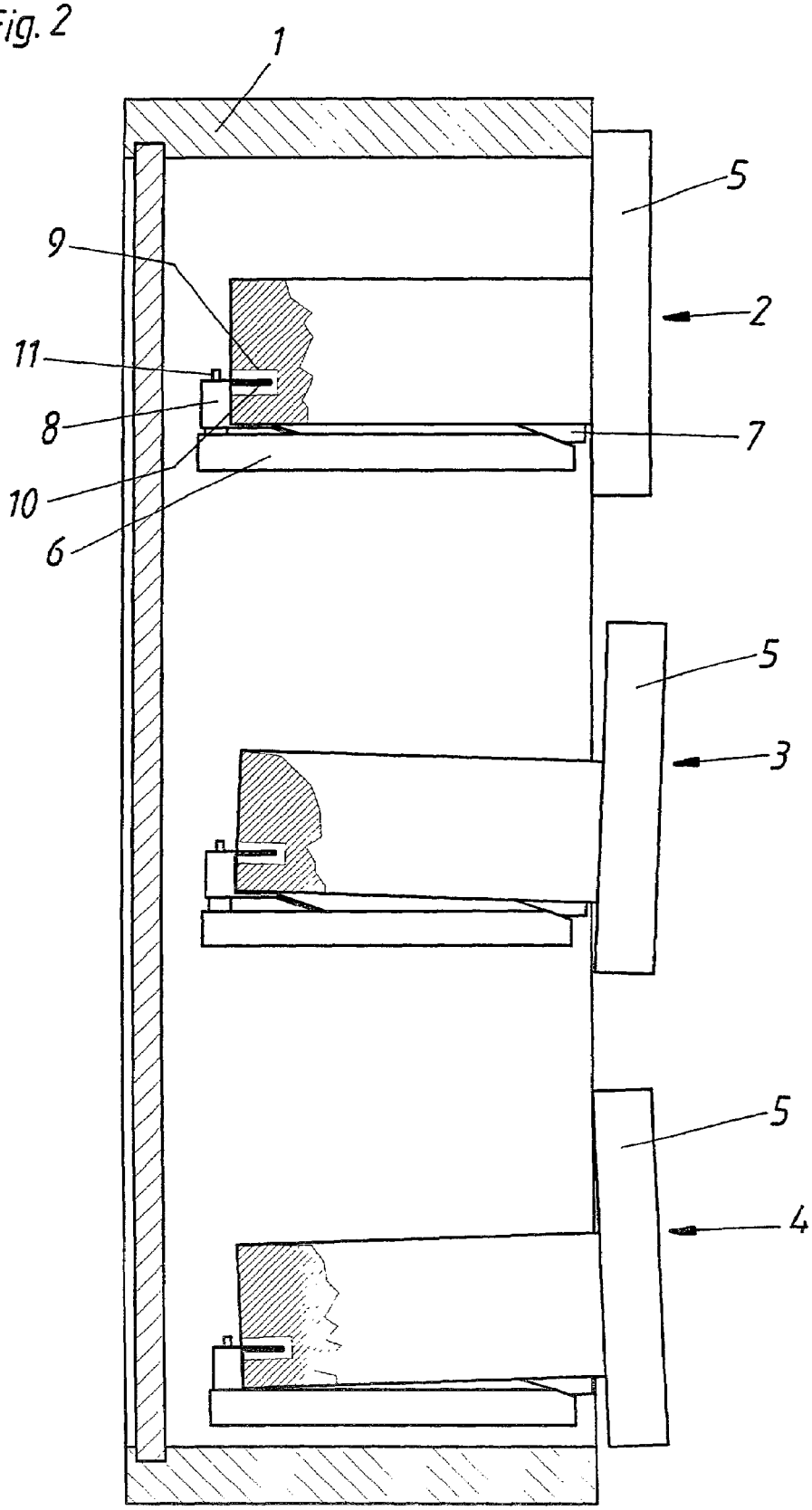
FIG. 2 shows a vertical section through an item of furniture with drawers.
Figure 4:
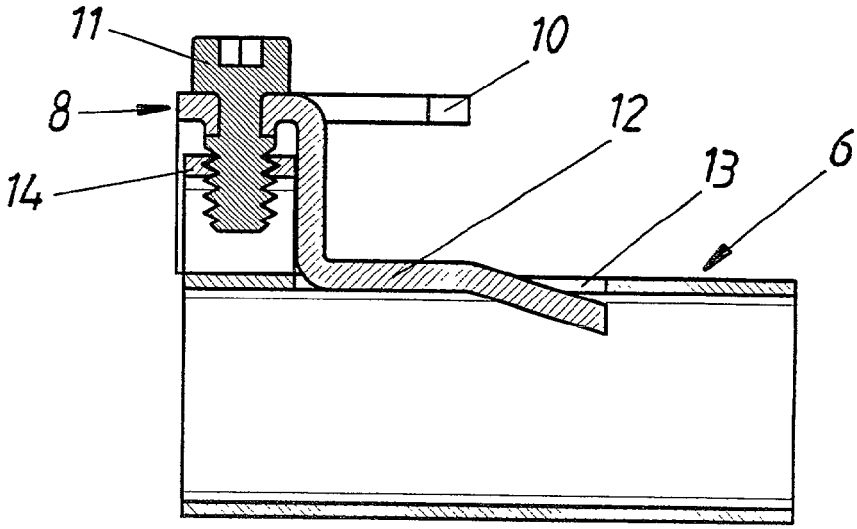
FIG. 4 shows a vertical section through the rear adjustment device on the rail side.

In the embodiment shown in FIGS. 2 to 4, the hook 8 is secured to a stirrup-shaped (U-shaped) piece 14 of the pull-out rail 6 by means of an adjusting screw 11, and is adjustable vertically with respect to the pull-out rail 6. In this connection, the screw 11 is connected form-fittingly to the hook 8 and engages a thread in the stirrup-shaped piece 14. The stirrup-shaped piece 14 may be punched out of the pull-out rail 6, or may be connected to the rail 6 by welding or the like.

The pull-out rail 6 also has, in the rear region thereof, a recess 13. A bearing tab 12 formed on the hook 8 projects into this recess 13, and in the mounted position the drawer frame or the drawer base lies on the bearing tab 12. The drawer 2, 3, 4 is thus held between the holding lug 10 of the hook 8 and the bearing tabs 12.

By turning the screw 11, the inclination of the drawer 2, 3, 4 (and, thus, the front panel 5) may be adjusted with respect to the furniture carcass 1 without any adjustment of the height of the front panel 5 taking place at the same time. Thus, the pull-out guide includes a mechanism (which, in this embodiment, includes screw 11 and component 14) for moving the holding lug 10 of hook 8 in the vertical direction.

In the second embodiment shown in FIGS. 5 to 9, the hook 8' and thus the lug 10 are adjustable by a mechanism including a handle 15, without a tool. In particular, the hook 8' is guided by a support 17. The support is U-shaped as seen in plan view, and is preferably made from a steel sheet which is connected to the pull-out rail 6' by, for example, welding. The support 17 has a recess in the form of a horizontal elongated hole 18. Provided on the handle 15 is an eccentric 16 which, in the mounted position, is received in the elongated hole 18 of support 17. An eccentrically-arranged peg 19, which projects into a hole 20 in the hook 8' is formed on the eccentric 16.

Figure 6:
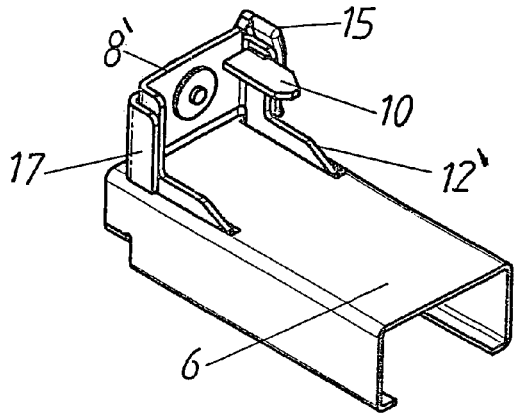
FIG. 6 shows an illustration of the embodiment of FIG. 5, with the adjustment device shown in the topmost position.
Figure 6:
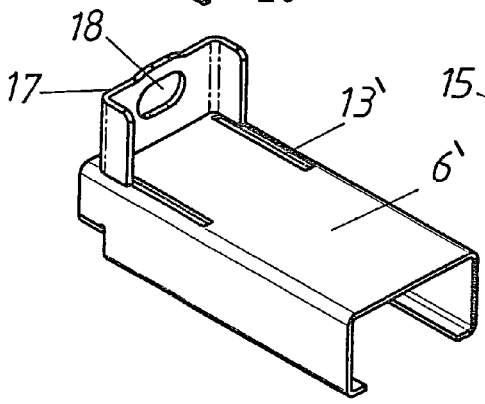
Figure 7:
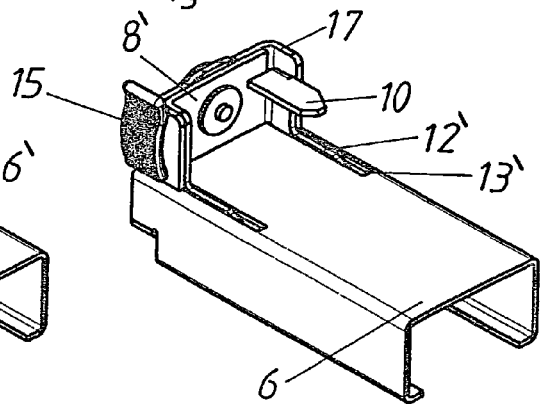
FIG. 7 shows an illustration of the adjustment device of FIGS. 5 and 6, with the adjustment device shown in the bottommost position.
Figure 8:
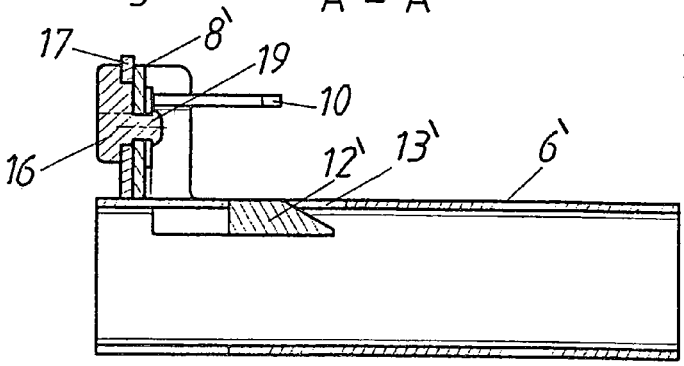
FIG. 8 shows a longitudinal section through the rear end of a pull-out rail and the adjustment device.
Figure 9:
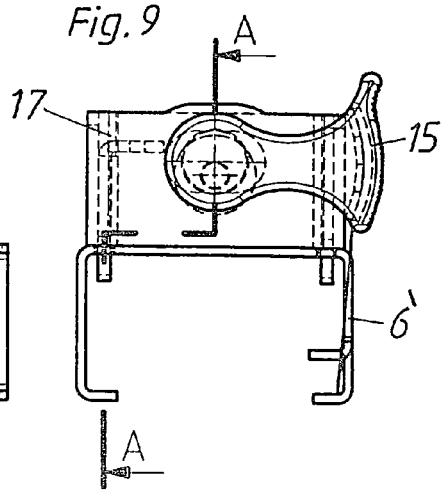
FIG. 9 shows an end view of the embodiment of the adjustment device and the pull-out rail of FIG. 8, as seen from the rear.

FIGS. 6 and 7 show the two limit positions of possible adjustment of the hook 8' and the lug 10. In both limit positions, the handle 15 is in each case resting on a side of the support 17 and the hook 8'. Height adjustment of the drawer is performed by pivoting the handle 15. This causes the eccentric 16 to rotate within hole 18. As a result, peg 19 inserted within hole 20 of hook 8' moves between an upper position and a lower position, lifting or lowering hook 8' with lug 10 as it moves.

The hook 8' is, in this embodiment, provided with two bearing tabs 12' which are received in slot-shaped recesses 13' in the pull-out rail 6'. A washer 21 is placed on the peg, and the peg 19 is riveted to the washer 21 to prevent the hook 8' and washer 21 from sliding off of the peg 19 (see FIG. 8).

Figure 10:
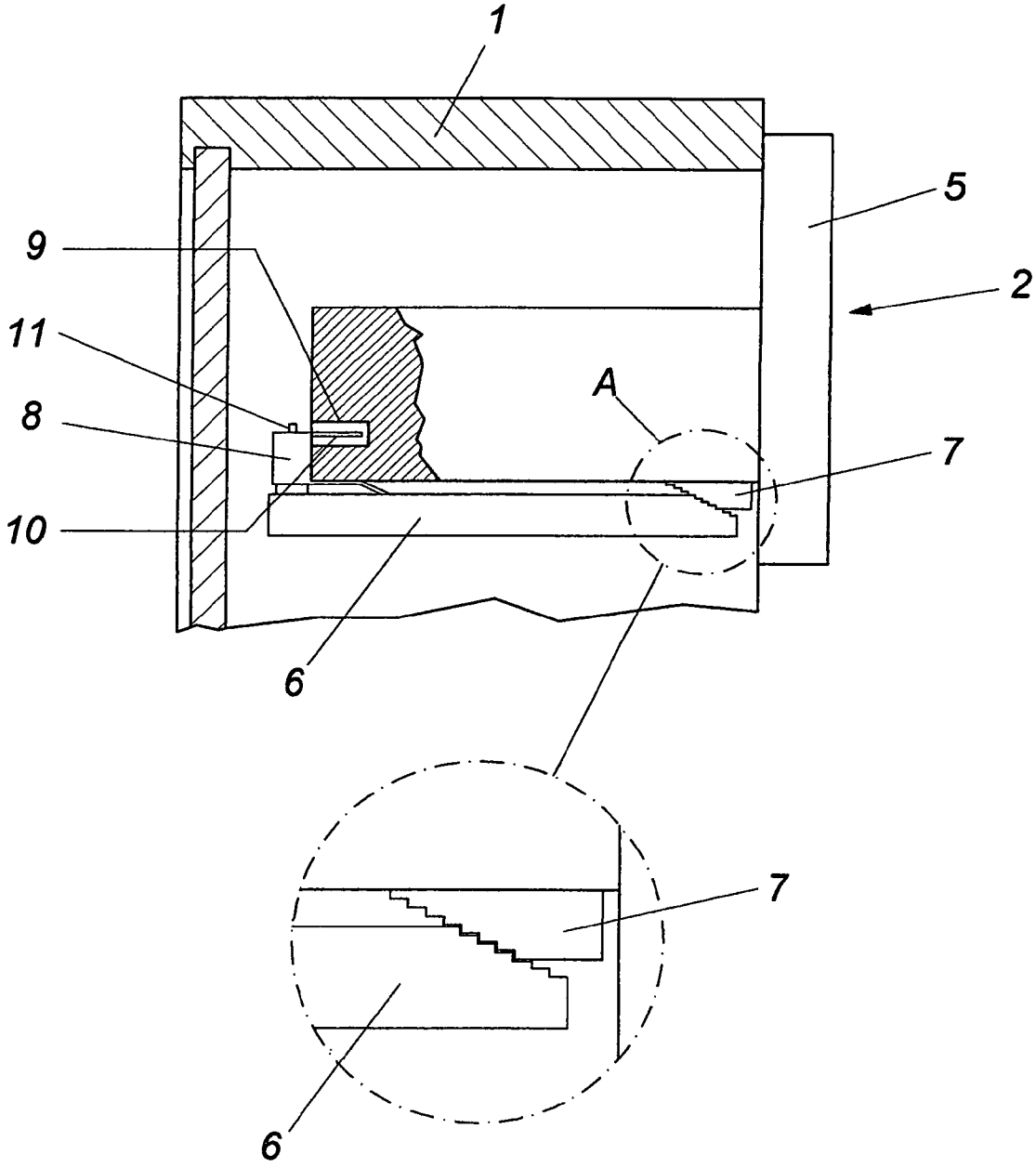
FIG. 10 shows a vertical section of the pull-out guide of the present invention, having steps formed on the wedges.

Once the height of the front panel 5 has been adjusted by displacing the wedges 7, undesired inclination of the front panel 5 may be compensated for by adjusting the hooks 8 with either the screw 11 of the first embodiment or the handle 15 of the second embodiment. The wedges may also be provided with steps for bearing against the pull-out rails, as shown in FIG. 10.

Only so-called simple pull-out devices have been described. The adjustment device according to the present invention could, however, be used with complete sets of pull-out devices, including pull-out rails, center rails, and support rails.

The invention claimed is:

1. A pull-out guide for drawers, comprising:

a pull-out rail to be connected to a drawer frame so as to support the drawer frame;

a hook including a holding lug, said hook being mounted at a rear end of said pull-out rail such that said holding lug extends in a horizontal direction so as to engage a rear end of the drawer frame to be supported on said pull-out rail; and a mechanism operable to move said holding lug in a vertical direction relative to said pull-out rail so as to move the rear end of the drawer frame in the vertical direction relative to said pull-out rail to change an angle of inclination of the drawer frame relative to said pull-out rail.

2. The pull-out guide of claim 1, wherein said hook is mounted at said rear end of said pull-out rail such that said holding lug is oriented to project into an opening at the rear end of the drawer frame so as to engage the drawer frame.

3. The pull-out guide of claim 1, wherein said mechanism includes an adjusting screw, said holding lug being integrally connected to said hook.

4. The pull-out guide of claim 1, wherein said mechanism includes an adjusting screw.

5. The pull-out guide of 1, wherein said hook further includes a main body portion, said holding lug having a basal end connected to said main body portion and having a distal end protruding from said main body portion in the horizontal direction.

6. A drawer comprising:

a drawer frame;

a pair of pull-out rails connected to said drawer frame so as to support said drawer frame;

a hook mounted at a rear end of each of said pull-out rails, each of said hooks including a holding lug extending in a horizontal direction such that said holding lug engages a rear end of said drawer frame; and a mechanism operable to move said holding lug in a vertical direction relative to said pull-out rail so as to move said rear end of said drawer frame in the vertical direction relative to said pull-out rail to change an angle of inclination of said drawer frame relative to said pull-out rail.

7. The drawer of claim 6, wherein said hook is mounted at a rear end of each of said pull-out rails such that said holding lug projects into an opening at said rear end of said drawer frame to engage said drawer frame.

8. The pull-out guide of 6, wherein each of said hooks further includes a main body portion, said holding lug of each of said hooks having a basal end connected to the corresponding main body portion of said each of said hooks and having a distal end protruding from the corresponding main body portion of said each of said hooks in the horizontal direction.

9. A drawer comprising:

a drawer frame including a front panel, a pair of side panels, and a rear panel;

a pair of pull-out rails, each of said pull-out rails being connected to a respective side of said drawer frame so as to support said drawer frame;

a hook mounted at a rear end of each of said pull-out rails, each of said hooks including a holding lug extending in a horizontal direction such that said holding lug engages a rear end of said drawer frame; and a mechanism mounted at a rear end of each of said pull-out rails, each of said mechanisms being operable to move said holding lug of a respective one of said hooks in a vertical direction relative to said pull-out rail so as to move said rear end of said drawer frame in the vertical direction relative to said pull-out rail to change an angle of inclination of said front panel relative to said pull-out rail.

10. The pull-out guide of 9, wherein each of said hooks further includes a main body portion, said holding lug of each of said hooks having a basal end connected to the corresponding main body portion of said each of said hooks and having a distal end protruding from the corresponding main body portion of said each of said hooks in the horizontal direction.

* * * * *